United States Patent [19]

Johnson

[11] Patent Number: 4,802,582

[45] Date of Patent: Feb. 7, 1989

[54] CONTINUOUS DRAW TAPE BAGS

[75] Inventor: James R. Johnson, Doraville, Ga.

[73] Assignee: AMI, Inc., Doraville, Ga.

[21] Appl. No.: 114,093

[22] Filed: Oct. 27, 1987

Related U.S. Application Data

[63] Continuation-in-part of Ser. No. 47,677, May 8, 1987, which is a continuation-in-part of Ser. No. 829,808, May 12, 1987, Pat. No. 4,664,649.

[51] Int. Cl.[4] ..... B65D 33/28

[52] U.S. Cl. ..... 206/390; 383/75

[58] Field of Search ..... 206/390; 383/75

[56] References Cited

U.S. PATENT DOCUMENTS

| | | | |
|---|---|---|---|
| 3,013,597 | 12/1961 | Moran | 383/6 |
| 3,029,853 | 4/1962 | Piazze | 383/6 X |
| 3,196,757 | 7/1965 | Samways | 383/75 X |
| 4,021,283 | 5/1977 | Weikert | 383/8 X |
| 4,364,490 | 12/1982 | Lang et al. | 206/390 X |
| 4,558,463 | 12/1985 | Boyd | 383/75 |

FOREIGN PATENT DOCUMENTS

| | | | |
|---|---|---|---|
| 43930 | 3/1971 | Finland | 383/8 |
| 2034102 | 12/1970 | France | 383/17 |
| 1006867 | 10/1965 | United Kingdom | 383/75 |

*Primary Examiner*—William Price

*Attorney, Agent, or Firm*—James B. Middleton

[57] ABSTRACT

Draw tape bags are provided on a roll, preferably folded longitudinally with the hems containing the draw tapes extending beyond the body of the bags for smooth rolling. The bags are side sealed with perforations between bags for separation of the bags, and the hems containing the draw tapes are side welded so that the hemmed areas are substantially separated. The bag machine for making side sealed bags includes a side welding unit in line with the sealing unit so the sealing and perforating, and welding, are accomplished in one step. The side welding knife has a large radius and high temperature to effect a weld in the multiple layers and the thick draw tape.

8 Claims, 2 Drawing Sheets

Fig. 1
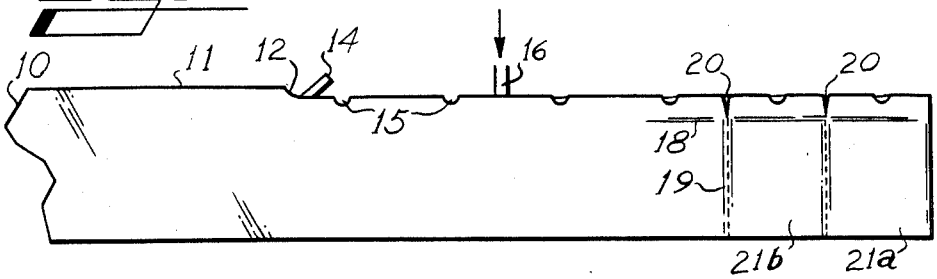
Fig. 2
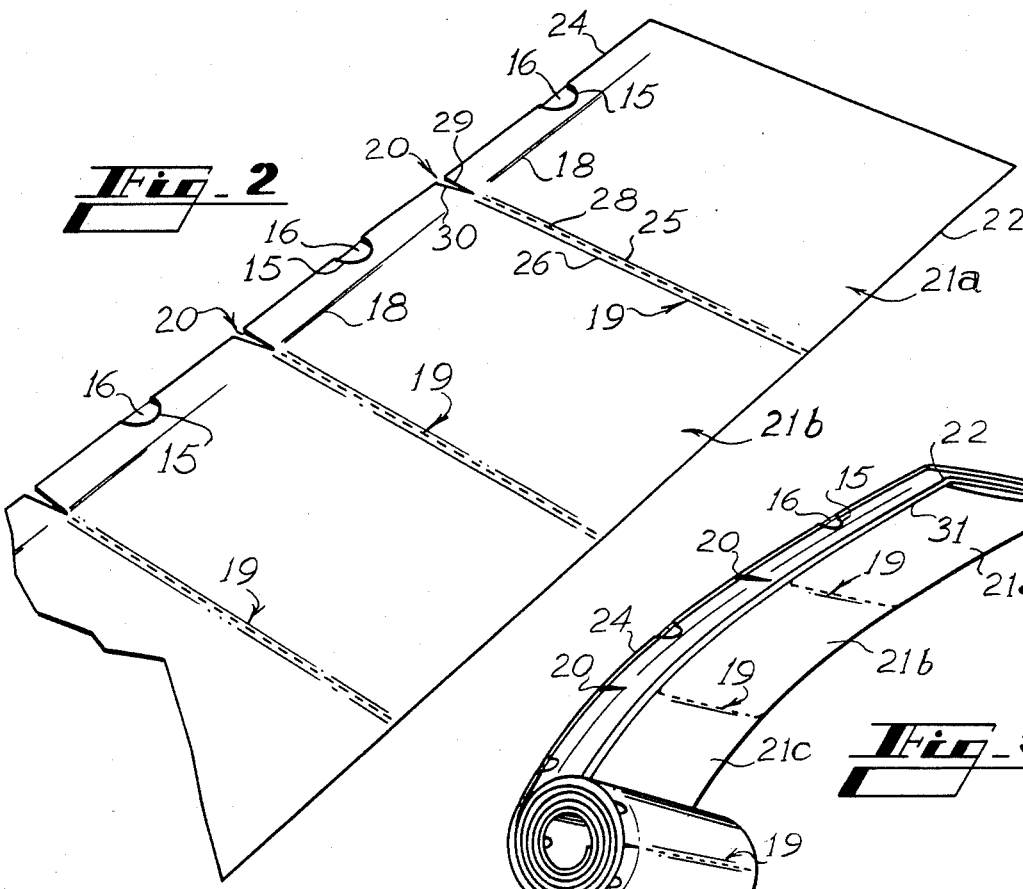
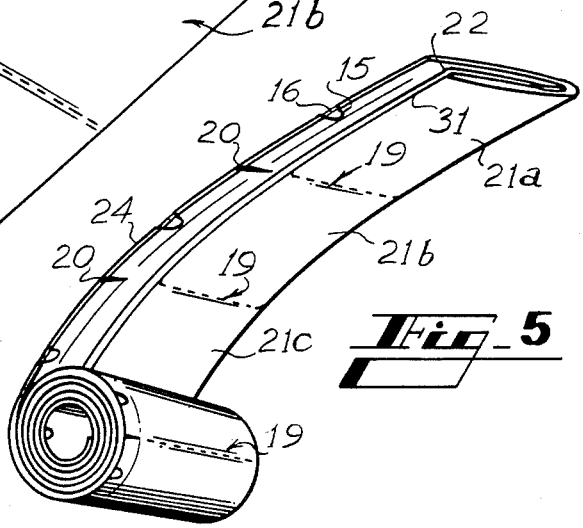
Fig. 5
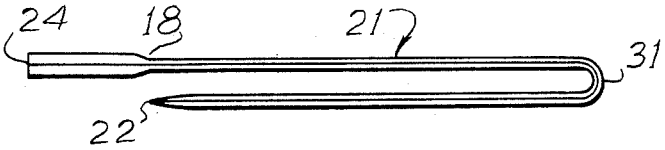
Fig. 3
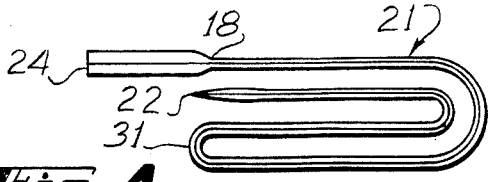
Fig. 4

CONTINUOUS DRAW TAPE BAGS

CROSS-REFERENCE TO RELATED APPLICATIONS

This application is a continuation-in-part of the prior application of James R. Johnson and Mark Hudgens, Ser. No. 47,677, filed May 8, 1987, which is in turn a continuation-in-part of application Ser. No. 829,808, filed May 12, 1987, now U.S. Pat. No. 4,664,649.

INFORMATION DISCLOSURE STATEMENT

Draw tape bags for use as trash bags and the like are currently very popular. The large draw tape bags are almost entirely bags that are side welded, the bags being separated from the web and subsequently folded and packaged. It has long been quite popular to provide plastic bags in a roll, the bags being joined to one another in continuous fashion, the sides of the bags being sealed, and with perforations between adjacent bags to allow easy separation by the consumer.

While it would be desirable to provide a draw tape trash bag in the continuous roll, the prior art has been unable to effect the desired side sealing with perforations and yet to seal the tape adequately within the upper hemmed area of the bag. There is therefore still a need for the provision of an efficient and high speed technique for providing draw tape trash bags in a continuous web that can be rolled if desired.

SUMMARY OF THE INVENTION

This invention relates generally to draw tape plastic bags, and is more particularly concerned with a bag that is a combination of a side welded and side sealed bag in a continuous strip, and a method and apparatus for forming the bag.

The present invention provides a draw tape plastic bag wherein the upper, hemmed portion of the bag contains a draw tape, and is side welded. The side weld extends only about as far as the hemmed edge; then, the body of the bag is side sealed, with perforations between adjacent bags to facilitate separation. It is contemplated that the bags will remain in a continuous strip of bags, and will be folded, then rolled.

In producing the bag of the present invention, a substantially conventional bag machine will be utilized, and methods and apparatus disclosed in the above identified co-pending applications can be used for providing the draw tape. Finally, a side welding unit is provided aligned with the side sealing unit so that one portion of the side of the bag is side welded while the remainder of the bag is side sealed and perforated.

BRIEF DESCRIPTION OF THE DRAWINGS

These and other features and advantages of the present invention will become apparent from consideration of the following specification when taken in conjunction with the accompanying drawings in which:

FIG. 1 is a schematic view showing a continuous web, and indicating the various steps for creating the bag of the present invention;

FIG. 2 is a perspective view showing a plurality of the bags of the present invention joined in a continuous strip;

FIG. 3 is an edge view showing the bag of the present invention after the first fold;

FIG. 4 is a view similar to FIG. 3 showing the bag after the second fold;

FIG. 5 is a perspective view illustrating a plurality of bags on a roll;

DETAILED DESCRIPTION OF THE EMBODIMENTS

Figure 6:
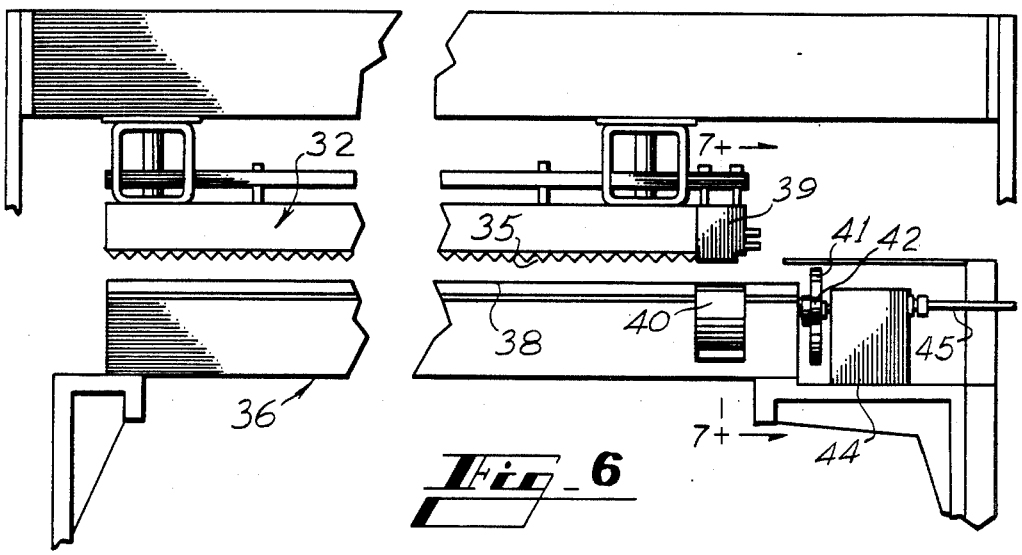
FIG. 6 is a partial, elevational view showing the side sealer and side welder for the present invention.

Referring now more particularly to the drawings and to those embodiments of the invention here presented by way of illustration, FIG. 1 shows, very schematically, the film at 10 as the film would emerge from an extruder. After the film has cooled, it will be flattened as at 11 to provide bag material. The material is then provided with a gusset as indicated at 12, the gusset being slit by the knife 14 for providing hemmed edges. The hemmed edge is then punched with holes 15. Following the punching of the holes 15, the draw tape 16 is inserted, the hem is sealed as indicated by the line 18; and finally, the side seams 19 and the side welds 20 are provided to complete the bag.

Those skilled in the art will readily understand from the above identified co-pending applications how the above described processing is carried out. The disclosures of the two above identified applications are incorporated herein by reference. The processing in accordance with the present invention is different only at the time of providing the side seals 19 and the side welds 20.

Looking at FIG. 2 in conjunction with FIG. 1, the bag itself is shown in more detail. The bags are indicated at 21A, 21B, 21C etc., each of the bags 21 being substantially identical to other bags. It will thus be seen in FIG. 2 that the bag 21 has a bottom edge 22 which is a folded edge and does not require sealing. The upper edge 24 has been hemmed as described above, the hole 15 has been punched, and the tape 16 inserted. Following insertion of the tape, the hem is sealed along the line 18 to confine the tape to the upper portion of the bag.

It is well known in the converting art to provide plastic bags having side seals with perforations between the seals to allow bags to be separated. It will be understood, however, that the sealing means normally used for the side seals of the bag cannot provide adequate sealing to secure the tape 16 within the hem. While the problem could perhaps be overcome through use of a prior art presealer or the like, it will be understood that the usual presealers are reciprocating devices that require that the material be stopped during the sealing operation. Since the web is otherwise continuously moving, the provision of a stop-start section on such a machine would lower the efficiency and greatly increase the complexity.

Thus, looking at FIG. 2 of the drawings, it will be seen that side seals are indicated at 25 on bag 21A and 26 on bag 21B. Between the seals 25 and 26 there is a perforation designated 28. Thus, the seal 19 extends form the lower edge 22 of the bags 21A substantially to the seal 18 for the hem of the bag. At the hem of the bag, the two bags 21A and 21B are separately welded so there is a weld 29 on the bag 21A and and a weld 30 on the bag 21B. These two welds are physically separated, though not necessarily longitudinally spaced.

By providing the side welds 29 and 30, it will be understood that a side welding blade can be utilized, the blade having sufficient radius and temperature to effect excellent welds to connect the hemmed edges of the bag material and to incorporate the tape 16. This will be discussed in more detail hereinafter.

Considering the plurality of contiguous bags as shown in FIG. 2 of the drawings, it should be understood that the bags will be relatively large, as normally used for trash bags and large garbage bags. To render this large bag more manageable for easy packaging and sales, it is contemplated that the bag will receive a double fold, and this is illustrated in FIGS. 3 and 4 of the drawings. Remembering that the upper edge 24 of the bag 21 is hemmed on both sides, and contains two draw tapes, it will be readily understood that the hemmed portion of the bag is considerably thicker than the body of the bag. It is therefore contemplated that the body of the bag will be folded substantially in half so that the lowercost edge 22 of the bag 21 will fall approximately around the seal 18 for the hem.

Following the fold as illustrated in FIG. 3, the bag will be folded again as illustrated in FIG. 4. Here it will be seen that the body of the bag has been folded a second time, the lower edge of the bag 22 remaining approximately at the hem seal 18. The intermediate portion 31 has now been brought around to be approximately in line with the lower edge 22.

After the web of bags has been folded as illustrated in FIG. 4, a discrete number of bags can be separated from the continuous web and placed into a roll as illustrated in FIG. 5. Since the hemmed portion of the bag has not been incorporated into the folded body of the bag, it will be understood that the bags will roll neatly, and the hemmed edge will extend to one side of the body of the bag with sufficient space that the smoothness of the roll is not affected.

In view of the structure of the bags, it will be seen that the bag 21A can be pulled from the roll. The side weld at 29 and 30 is already separated, so the slit at the welded hems can provide a designation and/or a starting point to tear the bag 21A from the bag 21B along the perforations 28.

Those skilled in the art will understand that, in the conventional machine to provide the side sealed, continuous bags, the side sealing blade is mounted on a shuttle arrangement. The side sealer blade moved alternately forward and back; and, the speed is designed so that there is a particular time wherein the side sealer blade is effectively stationary with respect to the moving web. At this time, the side sealer blade is activated to be engaged with the web. Those skilled in the art will also understand that the side sealer blade includes sufficient mechanism that the two adjacent seals are made simultaneously, and the perforation between the two seals is also provided in the same stroke.

Looking at FIG. 6, the side sealer blade that is conventional for such apparatus is indicated at 32, one of the sealing bars 32 being broken away to show the perforating member 35. Below the side sealer bar 32, there is a platen designated at 36. The platen typically includes a central groove 38 to receive the teeth of the perforating strip 35.

The above described apparatus is well known in the art, and no further description should be necessary for a full understanding by those of ordinary skill in the art.

As shown in FIG. 6 of the drawings, the body of the bag 21 will extend along the conventional side sealing bar 32. On the right hand end as viewed in FIG. 6, there is an additional member designated at 39, 39 being the side welding blade. Rather than the conventional platen 38, the side welding blade 39 is engaged with a roller platen 40.

Because of the nature of the tape used as the draw tape, a higher temperature is required for the side welding blade 39 than for the sealing bar 32. Also, because a portion of the bag is being welded, and the two bags separated, it will be understood that the side welding blade 39 must engage the plastic material long enough that a bead is rolled on each adjacent edge, and the two edges are separated. Because of this technique, it is at least possible that some of the plastic material will adhere to the platen.

In an effort to prevent problems in the processing, the platen 40 is rotatable. The platen 40 is carried on a spindle to which a gear 41 is connected. The gear 41 is meshed with a gear 42, the gear 42 being carried by the shaft of a motor 44. The motor 44 is shown as having a hose connection 45, it being contemplated that the motor 44 will be activated by air under pressure. Obviously, any form of motive means may be utilized, the object being simply to rotate the platen 40 by a few degrees of rotation following each welding operation.

Figure 7:
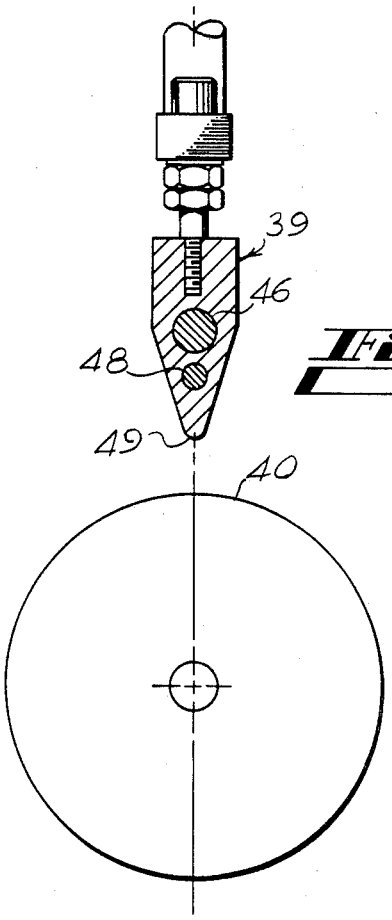
FIG. 7 is an enlarged cross-sectional view taken substantially along the line 7—7 in FIG. 6; and, FIG. 8 is a schematic illustration showing another common form of machine for providing the side sealed bags, and, in conjunction with FIG. 9, showing the modification required to provide the side welded hemmed area.

Looking at FIG. 7 of the drawings, it will be seen that the side welding blade 39 is shown enlarged, and in cross-section. In FIG. 7 it will be seen that there is a conventional heater 46 for providing the necessary amount of heat in the blade 39. Below the heater 46, there is a thermocouple 48. The thermocouple 48 is closer to the operational tip 49 so the temperature of the tip 49 will be sensed and, through well known means, control the operation of the heater 46.

A typical trash bag made in accordance with the present invention might have a bag body made of linear low density polyethylene (LLDPE) film approximately 1 mil thick. Such bags popularly range from about 0.7 to 1.5 mil in thickness. It will therefore be understood that relatively low temperatures, around 375° F., and brief dwell-times will provide an excellent seal between two thicknesses of this material. Contrarily, the hemmed area of the trash bags will typically include a ribbon having a thickness around 2 mils, and the ribbon almost always includes some high molecular weight high density polyethylene (HMWHDPE). As is discussed in the parent applications, in order to obtain a good weld at the edges of the bag in the hemmed area, it is necessary to use a high temperature, around 800° F., and use a relatively large radius on the side welding blade.

While one radius cannot be specified for all conditions, it will be understood that a typical side welding blade used for 1 mil LLDPE will have a radius of about 0.016". By contrast, a typical side weld bar for a bag hem having the four thicknesses of 1 mil LLDPE and two thicknesses of 2 mil ribbon made of HMWHDPE will require a radius of about 0.062". It will be understood that, as the materials are harder to seal, and require a larger bead for the needed strength, the radius of the blade will increase, and as the plastic is sealed easily with less of a bead, a smaller radius is appropriate. Variations in the radius can be made to suit the particular circumstances. Generally the minimum radius for achieving a good weld is 0.047", and the maximum is about 0.092". The optimum radius is about 0.062" as is stated for the preferred embodiment.

Figure 8:
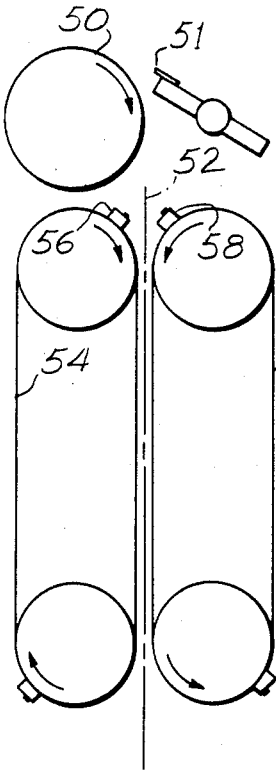

Looking next at FIG. 8 of the drawings, it will be understood that the method of the present invention can be carried out with other apparatus to achieve the same novel bag. FIG. 8 illustrates, schematically, another common form of machine for providing the continuous web of bags that are side sealed and perforated. In this apparatus, there is a rotating roller 50 to act as a platen for a perforator 51. The centerline 52 indicates the path of bag material so the perforator 51 rotates counterclockwise, as indicated by the arrow, and engages the bag material, pressing against the platen 50 for creating perforations. This activity is appropriately timed with a pair of belts indicated at 54 and 55. The belts 54 and 55 carry sealing bars 56 and 58, the sealing bars 56 and 58 each having a hot wire or the like disposed thereon. As the belts 54 and 55 travel as indicated by the arrows on the upper drums, the sealing bars 56 and 58 will engage the web along the path 52. The sealing wires will be spaced apart so that one seal is created on each side of the perforation created by the perforator 51.

Figure 9:
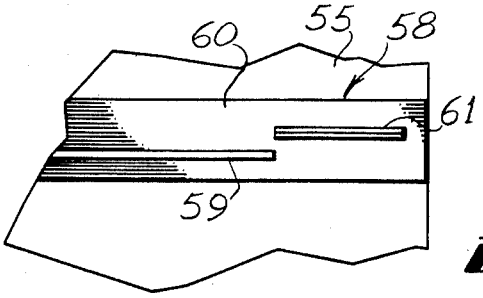

Looking then at FIG. 9 of the drawings, the belt 55 is shown fragmentarily, with a fragmentary portion of the sealing bar 58. The sealing bar 58 has a sealing wire 59 which will extend completely across the belt 55 as is well known in the art. It will be seen that the sealing wire 59 is substantially at one edge of the sealing bar 58, and the upper portion 60 of the sealing bar 58 will act as a platen against which the opposite sealing wire will seal.

To adapt the arrangement to the present invention, there is a side welding means 61 provided at the end of the sealing bar 58. While not here shown in detail, from the above description it should be understood that the welding means 61 may take the form of a distinct blade as is shown in FIG. 7 of the drawings, or may be a heated wire or the like such as the wire 59. The above discussion should be considered in selecting the wire, a larger diameter wire obviously being required to effect the desired weld in the several layers of material.

From the foregoing discussion it will be understood that the present invention privides a unique bag wherein the hemmed portion of a draw tape bag is side welded and the body portion is side sealed and perforated.

While the side weld has been described as extending through the hemmed portion of the bag, it should be realized that some variation is possible. The important point is to have the draw tape well sealed on the bag side of the tape. Primary stress on the draw tape is exerted on the bag side, so a good weld secures the tape. It has been found, however, that the top edge of the bag need not have the weld.

One will usually try to weld the full width of the hem, but a small tab at the top edge of the bag can be left unwelded and the bag is still of good quality. The unwelded tab may be around an eighth of an inch or so, and will be mostly bag material. If the draw tape is unwelded at the top, the unwelded width will be very slight, perhaps a sixteenth inch or less. There is therefore some latitude in placing the side welding blade without producing unsatisfactory bags.

The unique bags of the present invention are admirably adapted for folding twice while allowing the hemmed portion to extend beyond the folded body portion so that a neat roll of bags can be provided. The bag can be made by several existing forms of bag making apparatus, so long as the conventional apparatus is modified as set forth above to include the side welding portion in line with the side sealing portion.

It will of course be understood by those skilled in the art that the particular embodiments of the invention here presented are by way of illustration only, and are meant to be in no way restrictive; therefore, numerous changes and modifications may be made, and full use of equivalents resorted to, without departing from the spirit or scope of the invention as outlined in the appended claims.

What is claimed is:

1. A plurality of draw tape bags defined along a web of bag material, each bag of said plurality of bags having opposed parallel side walls, a lower edge of said side walls joining said opposed side walls, and upper hemmed edges parallel to said lower edge and including a hem in each of said side walls and a draw tape within each of said hems, said web of bag material including a plurality of side seals generally perpendicular to said lower edge, said plurality of side seals being so arranged that two side seals are adjacent to each other between adjacent bags along said web of bag material, said web defining a line of perforations between said two side seals adjacent to each other, and a plurality of side welds extending generally through said hems.

2. A plurality of draw tape bags as claimed in claim 1, said plurality of side welds being generally aligned with said line of perforations, each bag of said adjacent bags having one of said side welds for sealing said hem and said draw tape.

3. A plurality of draw tape bags as claimed in claim 2, and further including hem seals extending generally parallel to said upper hemmed edges for sealing said hems to said side walls, said line of perforations extending approximately from said hem seals to said lower edge, said side welds extending approximately from said upper hemmed edges to said hem seals.

4. A plurality of draw tape bags as claimed in claim 3, said side welds being generally parallel to and aligned with said line of perforations, said web of bag material having a thickness in the range below 1.5 mil, said draw tape having a thickness of about 2 mils.

5. A plurality of draw tape bags as claimed in claim 4, said side welds being sufficient to weld said hems and said drawtape together.

6. A plurality of draw tape bags as claimed in claim 1, said bags being folded longitudinally of said web so that said lower edge is approximately aligned with said hem.

7. A plurality of draw tape bags as claimed in claim 6, said bags being further folded longitudinally of said web so that said hems extend beyond the folded bag, and said opposed side walls are folded generally in quarters.

8. A plurality of draw tape bags as claimed in claim 7, said plurality of bags being rolled about an axis parallel to said side seals.

* * * * *